US010493325B2

(12) United States Patent
Chiang

(10) Patent No.: US 10,493,325 B2
(45) Date of Patent: Dec. 3, 2019

(54) SWIMMING GOGGLE STRUCTURE

(71) Applicant: Global Esprit Inc., New Taipei (TW)

(72) Inventor: Herman Chiang, New Taipei (TW)

( * ) Notice: Subject to any disclaimer, the term of this patent is extended or adjusted under 35 U.S.C. 154(b) by 246 days.

(21) Appl. No.: 15/647,290

(22) Filed: Jul. 12, 2017

(65) Prior Publication Data

US 2018/0339197 A1 Nov. 29, 2018

(30) Foreign Application Priority Data

May 26, 2017 (TW) ..... 106207664 U

(51) Int. Cl.
*A63B 33/00* (2006.01)
*A63B 71/10* (2006.01)

(52) U.S. Cl.
CPC ..... *A63B 33/002* (2013.01); *A63B 71/10* (2013.01); *A63B 2033/004* (2013.01)

(58) Field of Classification Search
CPC ..... A63B 33/002; A63B 2033/004
USPC ..... 2/445, 446
See application file for complete search history.

(56) References Cited

U.S. PATENT DOCUMENTS 6,070,272 A * 6/2000 Chiang ..... A63B 33/002 2/428
6,112,334 A * 9/2000 Chiang ..... A63B 33/002 2/428
2019/0070464 A1* 3/2019 Chiang ..... A63B 33/002

* cited by examiner

*Primary Examiner* — Katherine M Moran

(57) ABSTRACT

A swimming goggle structure comprises a left frame, a right frame and a connection element formed therebetween. The left frame and the right frame respectively have an inner peripheral face, an outer peripheral face, a lens, a protection pad and a head strap base. The protection pad has a connecting circumference and a face contact circumference, and the connecting circumference is secured to the inner peripheral face of the left (right) frame, characterized in that: the left frame and the right frame are respectively arranged with a first buffer member. The first buffer member is located between the inner peripheral face and the outer peripheral face and close to a lower side of the connection element, and comprises a plurality of compartments. Each of the plurality of compartments has an opening which provides a flexible support to absorb the impact that acts on the wearer's nose bridge from several directions.

9 Claims, 7 Drawing Sheets

SWIMMING GOGGLE STRUCTURE

BACKGROUND OF THE INVENTION

1. Field of the Invention

The present invention relates generally to a pair of swimming goggles and in particular to a novel swimming goggle structure which provides a strong protection for the wearer's nose bridge and eye corners.

2. Description of Related Art

In a competition of Ironman triathlon, players need to complete certain competition items such as swimming, cycling and marathon in order for a limited time, and a necessary time for players to change their clothes and shoes during the change of items is reasonably counted in the limited time. Therefore, players need to do some fitness training and endurance work before the competition, and training for the change of competition items is important to make sure every competition item can be perfectly completed.

Among the competition items of Ironman triathlon, the "swimming" item requires players to crowd into an open waterway, which is an emotional moment full of spectacle. However, it is also a moment that players may cause accidental collisions due to the crowd and the big stroke movement, which increases the possibility of touching or hitting the swimming goggles on players' faces. Once the swimming goggles are touched or hit, the nose bridge or eye corners may get hurt as a vulnerable part of face. Therefore, it remains to be clarified how the swimming goggles are designed suitable for swimming competition in order to protect those vulnerable parts of face.

SUMMARY OF THE INVENTION

It is an object of the present invention to provide a swimming goggle structure, which provides the wearer's nose bridge and eye corners with a comfortable engagement and with a security buffer against the shock caused by being accidentally hit in swimming, so as to reduce the harm of the wearer's nose bridge and eye corners and to achieve comfortable wearing and shock absorbing performance.

To achieve the object, a swimming goggle structure in accordance with the present invention comprises: a left frame and a right frame, respectively having an inner peripheral face, an outer peripheral face, a lens, a protection pad and a head strap base; and a connection element, interposed between the left frame and the right frame, wherein each of the protection pads has a connecting circumference and a face contact circumference, and the connecting circumference is secured to the inner peripheral face of the left frame and the right frame, while the face contact circumference is engaged with the eye socket of the wearer, characterized in that: the left frame and the right frame are respectively arranged with a first buffer member, and the first buffer member is located between the inner peripheral face and the outer peripheral face, and comprises a plurality of compartments, each of the plurality of compartments having an opening which provides a flexible support to absorb the impact that acts on the wearer's nose bridge from several directions.

In accordance with the present invention, the left frame and the right frame are respectively arranged with a second buffer member, and the second buffer member is located at a side of the connecting circumference of the protection pad and close to the connection element and the first buffer member, and the second buffer member comprises an arc support rib, and the arc support rib has a penetrating archway which provides a support and returning force against a structural deformation.

In accordance with the present invention, the left frame and the right frame are respectively arranged with a third buffer member, and the third buffer member is located at a side of the connecting circumference of the protection pad opposite the second buffer member, and the third buffer member comprises an arc support rib, and the arc support rib has a penetrating archway which provides a support and returning force against a structural deformation.

DESCRIPTION OF THE INVENTION

Figure 4:
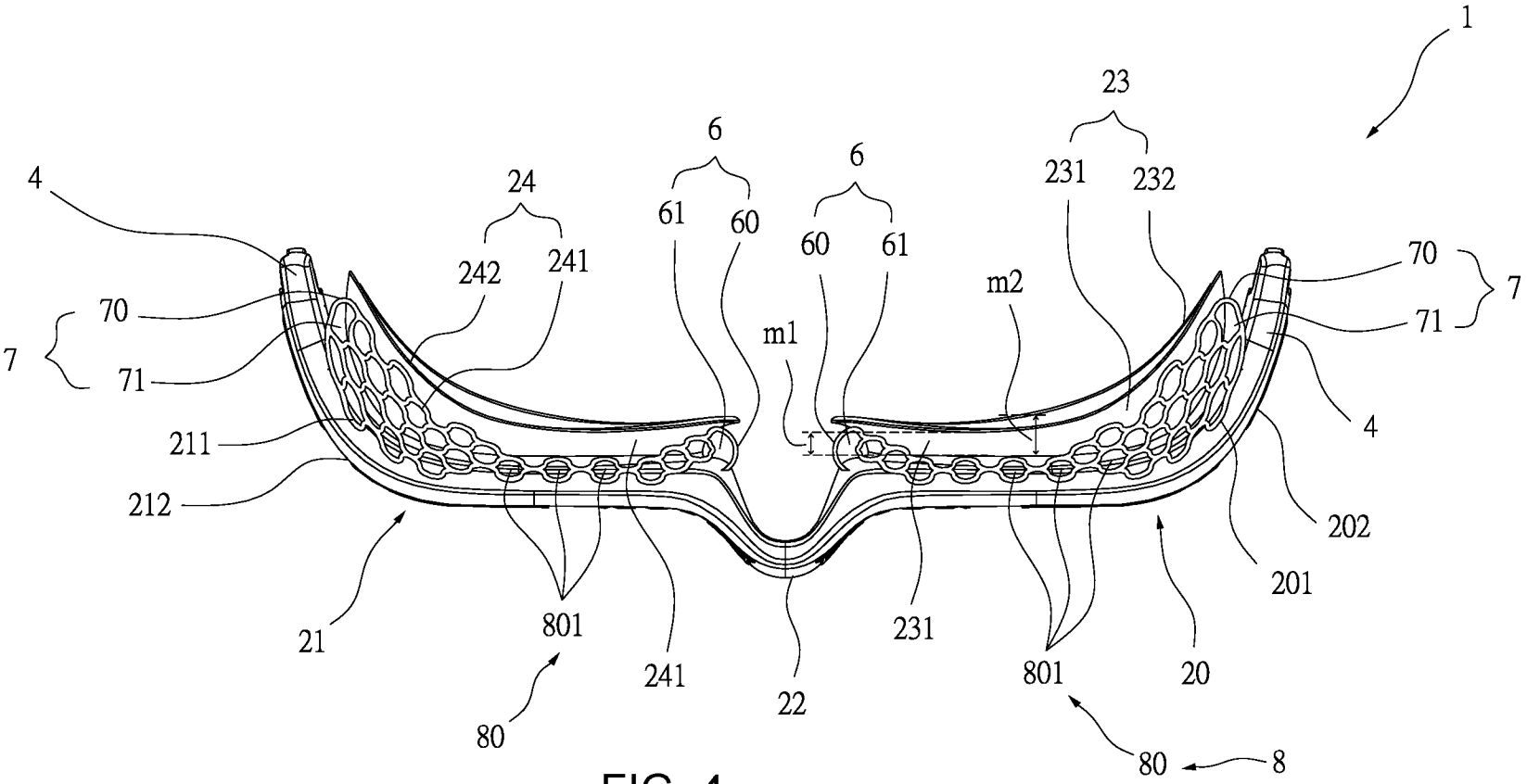
Figure 5:
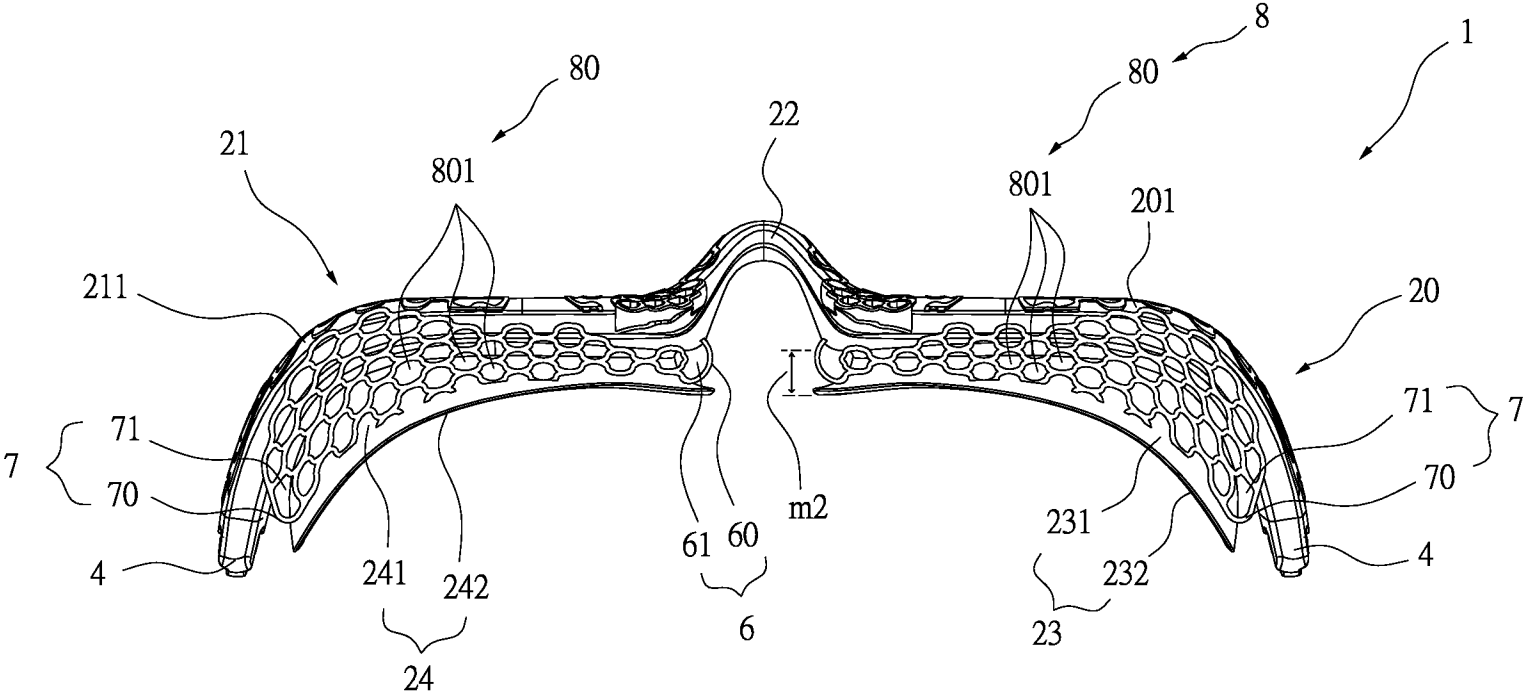
Figure 6:
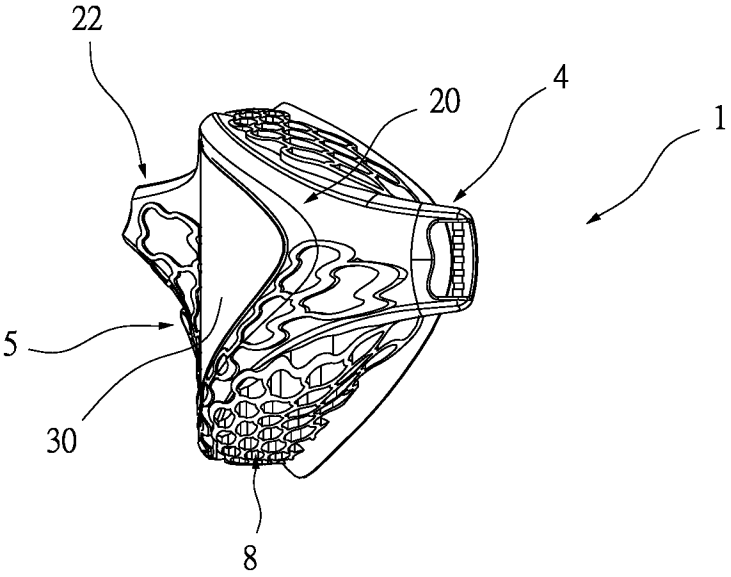
Figure 8:
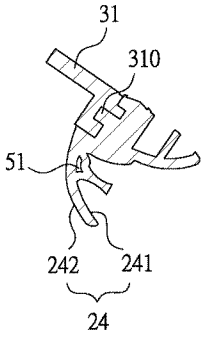
FIG. 8 is a cross-sectional view taken along line 8-8 of FIG. 3.
Figure 7:
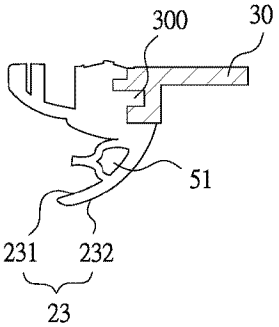
FIG. 7 is a cross-sectional view taken along line 7-7 of FIG. 3.

Referring to FIGS. 1-6, a pair of swimming goggles 1 in accordance with the swimming goggle structure of the present invention comprises a left frame 20, a right frame 21, a connection element 22, two lenses 30,31, two protection pads 23,24, two head strap bases 4, two first buffer members 5, two second buffer members 6, two third buffer members 7 and two fourth buffer members 8. The left frame 20, the right frame 21, the connection element 22 and the protection pads 23,24 may be made of thermal plastic rubber and integrally formed by plastic injection molding. The left frame 20 has a receiving groove 200 used for accommodating the lens 30, and the right frame 21 has a receiving groove 210 used for accommodating the lens 31. The left frame 20 and the right frame 21 respectively have an inner peripheral face 201(211) and an outer peripheral face 202(212). The lenses 30,31 are made of polycarbonate resin, or cellulose acetate or cellulose propionate sheet, and required to be implanted in the pair of swimming goggles prior to the formation of the left frame 20, the right frame 21, the connection element 22 and the protection pads 23,24 in plastic injection molding. Furthermore, each of the lenses 30,31 is disposed with a circular groove 300(310) used to combine with the receiving groove 200(210) of each of the left frame 20 and the right frame 21 during the formation of the left frame 20, the right frame 21, the connection element 22 and the protection pads 23,24 in plastic injection molding so as to provide a stable combination between the lenses 30,31 and the left and right frames 20,21. Each of the protection pads 23,24 has a connecting circumference 231 (241) and a face contact circumference 232(242). The connecting circumference 231(241) is secured to the inner peripheral face 201(211) of the left frame 20 and the right frame 21, and the face contact circumference 232(242) is used to make contact with the eye socket of the wearer. It is noted that each of the protection pads 23,24 (FIGS. 4 and 5)

has an axial length m1 with respect to a portion of the eye socket near the eyebrow (FIG. 4), and has an axial length m2 with respect to a portion of the eye socket near the zygomatic bone (FIG. 5), wherein the axial length m1 is less than the axial length m2, so that the protection pads 23,24 provide a contact engagement with the eye socket contour naturally having a raised top and a concave bottom, so as to provide a comfortable engagement with the face skin of the wearer. The head strap bases 4 are disposed on outer sides of the left frame 20 and the right frame 21 for assembly of a head strap.

With reference to FIGS. 2, 3 and FIGS. 7, 8, the first buffer members 5 are separately arranged on the left frame 20 and the right frame 21. Each of the first buffer members 5 is located between the inner peripheral face 201(211) and the outer peripheral face 202(212) and close to a lower side of the connection element 22. The first buffer member 5 comprises a plurality of compartments 51. The plurality of compartments 51 are extended from the inner peripheral face 201(211) to the outer peripheral face 202(212) in an interlaced arrangement to form a curved contact surface 511. Each of the plurality of compartments 51 has an opening 512 toward the outer peripheral face 202(212). With difference on shape of the opening 512, the plurality of compartments 51 may form a honeycomb structure, an elliptical structure or a rectangular structure, e.g. a honeycomb structure is taken as an example in this embodiment. After the pair of swimming goggles 1 is worn, the curved contact surfaces 511 come in contact with the nose bridge providing a comfortable touch while the plurality of compartments 51 of the first buffer members 5 are pushed or compressed against both sides of the nose bridge. Further, the openings 512 of the plurality of compartments 51 provide a flexible support to absorb the impact that acts on the nose bridge from several directions, so as to reduce the harm of the nose bridge in swimming and to achieve comfortable wearing and shock absorbing performance.

Figure 1:
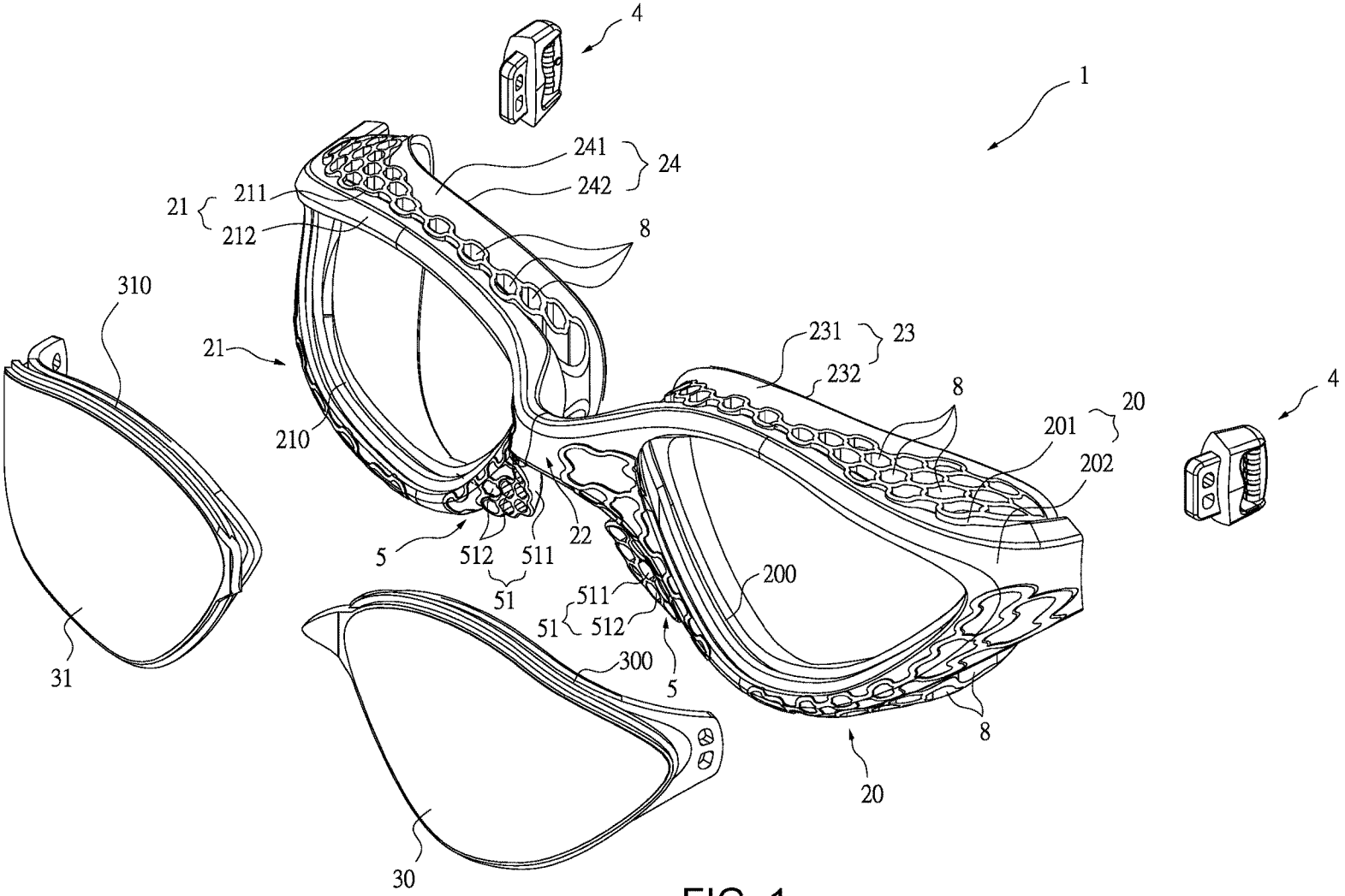
FIG. 1 is an exploded perspective view of a swimming goggle structure in accordance with the present invention.
Figure 2:
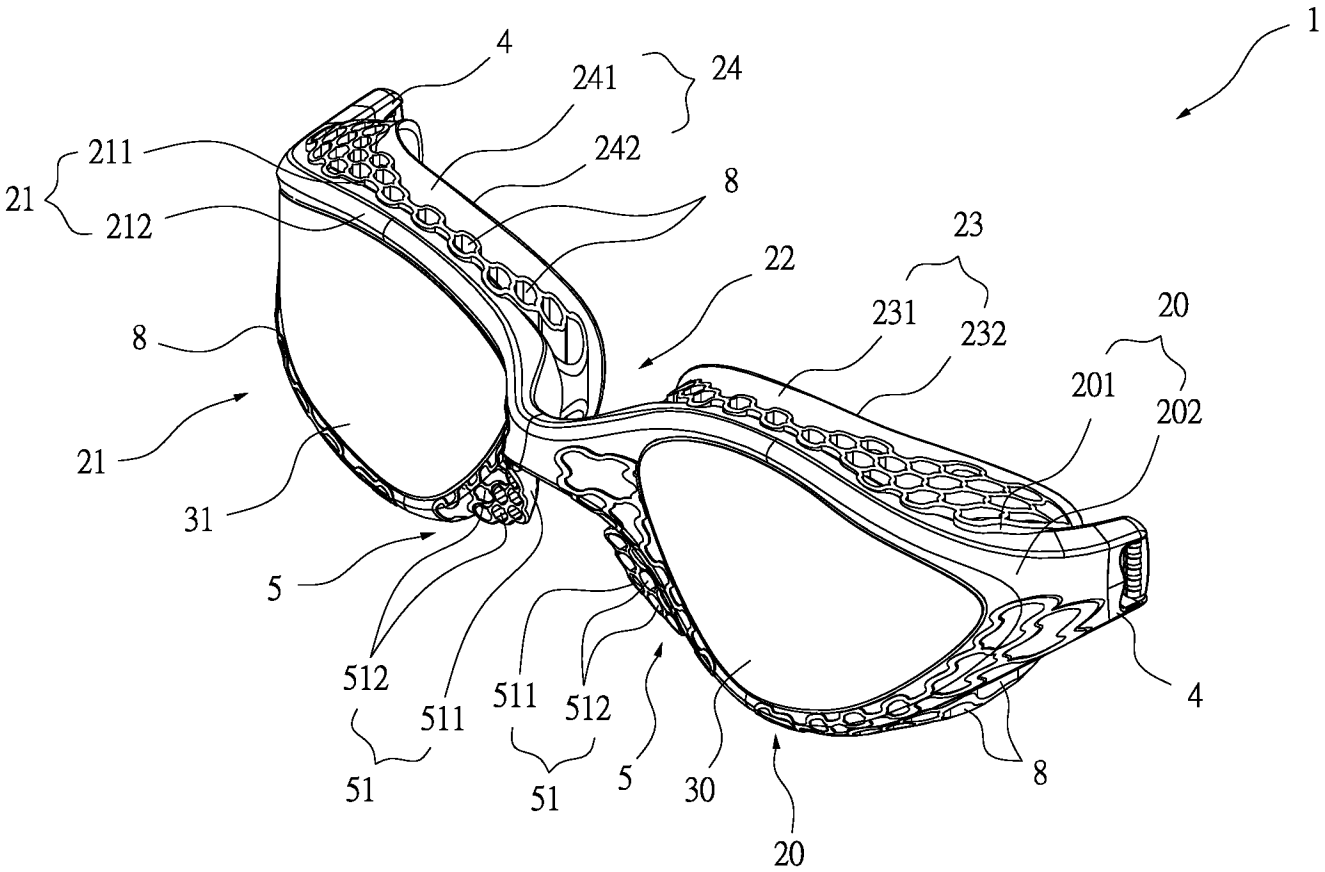
FIG. 2 is an assembled perspective view of a swimming goggle structure in accordance with the present invention.
Figure 3:
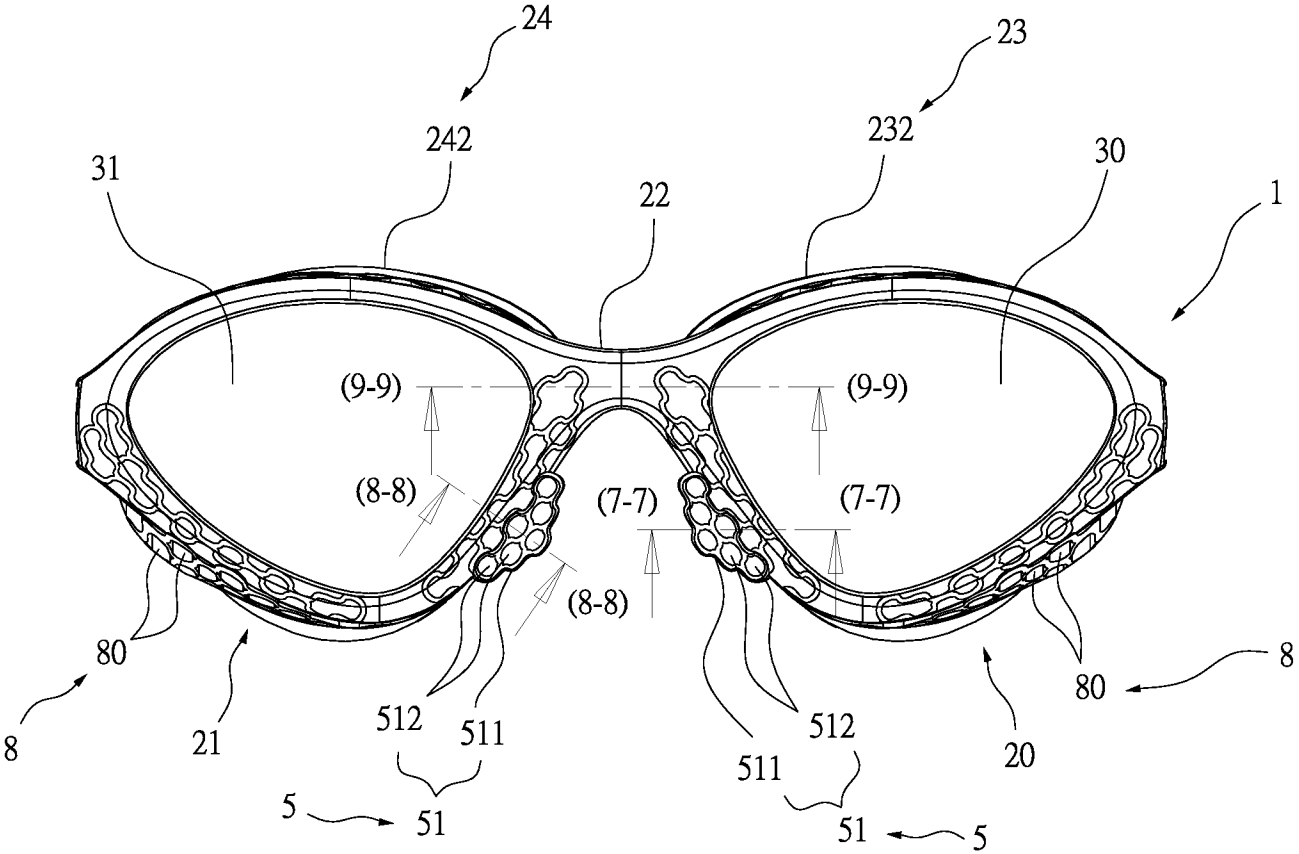
FIGS. 3-6 are a front view, a top view, a bottom view and a right-side view of FIG. 2.
Figure 9:
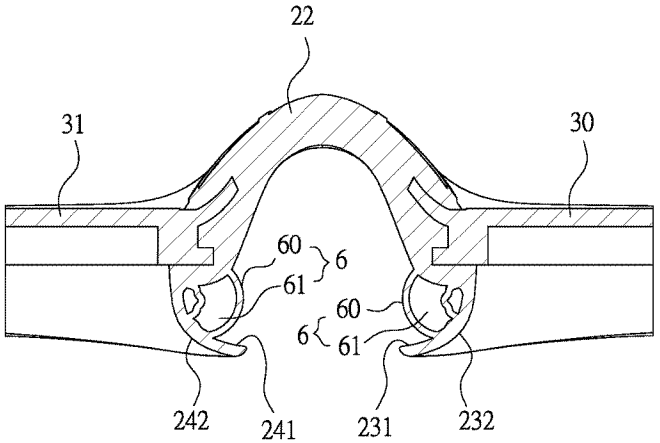
FIG. 9 is a cross-sectional view taken along line 9-9 of FIG. 3.

With reference to FIGS. 4, 5 and 9, the second buffer members 6 are separately arranged on the left frame 20 and the right frame 21. Each of the second buffer members 6 is located at a side of the connecting circumference 231(241) of the protection pad 23(24) and close to the connection element 22 and the plurality of compartments 51 (FIG. 2). Each of the second buffer members 6 comprises an arc support rib 60. The arc support rib 60 has a penetrating archway 61 which provides a support and returning force against the structural deformation in order to reduce the harm of between the nose bridge and the eye socket (FIG. 9) during collision accidents.

With reference to FIGS. 4 and 5, the third buffer members 7 are separately arranged on the left frame 20 and the right frame 21. Each of the third buffer members 7 is located at a side of the connecting circumference 231(241) of the protection pad 23(24) opposite the second buffer member 6. Each of the third buffer members 7 comprises an arc support rib 70. The arc support rib 70 is protruded toward the head strap base 4 and has a penetrating archway 71 which provides a support and returning force against the structural deformation in order to reduce the harm of the outer eye corner during collision accidents and to achieve comfortable wearing and shock absorbing performance.

With reference to FIGS. 4, 5 and 9, the fourth buffer members 8 are separately arranged on the left frame 20 and the right frame 21. Each of the fourth buffer members 8 is located between the inner peripheral face 201(211) of the left (right) frame 20(21) and the connecting circumference 231(241). The fourth buffer member 8 comprises a plurality of compartments 80. Each of the plurality of compartments 80 has an opening 801. With difference on shape of the opening 801, the plurality of compartments 80 may form a honeycomb structure, an elliptical structure or a rectangular structure, e.g. a honeycomb structure is taken as an example in this embodiment, which not only provides an overall visual feeling along with an appearance of the left frame 20 and the right frame 21, but also provides the protection pads 23,24 with the buffering effect. Sizes of the compartments 80 increase gradually along with the extension of the fourth buffer member 8 from a portion near the nose bridge to a portion near the outer eye corner (FIGS. 4 and 5), and an amount of the compartments 80 at a portion near the eyebrow (FIG. 4) is less than an amount of the compartments 80 at a portion near the zygomatic bone (FIG. 5), so as to match the protection pads 23,24 of which an axial length m1 near the eyebrow is less than an axial length m2 near the zygomatic bone, and thus to match the contour of the eye socket having the raised top and the concave bottom to provide a preferable buffer effect.

In sum, the pair of swimming goggles 1 in accordance with the present invention provides the first buffer members 5 which reduce the harm of the nose bridge under impact, and provides the second buffer members 6 located near both sides of the nose bridge and the third buffer members 7 located near the outer eye corners to reduce the harm of the outer eye corners under impact to achieve comfortable wearing and shock absorbing performance. And further, the fourth buffer members 8 are provided to reduce the harm around the eye sockets.

It is understood that the invention may be embodied in other forms within the scope of the claims. Thus the present examples and embodiments are to be considered in all respects as illustrative, and not restrictive, of the invention defined by the claims.

What is claimed is:

1. A swimming goggle structure, comprising:

a left frame and a right frame, respectively having an inner peripheral face, an outer peripheral face, a lens, a protection pad and a head strap base; and a connection element, interposed between the left frame and the right frame, and integrally formed with the left frame, the right frame and the protection pads;

wherein each of the protection pads has a connecting circumference and a face contact circumference, and the connecting circumference is secured to the inner peripheral face of the left frame and the right frame, and the face contact circumference is used to make contact with the eye socket of the wearer, characterized in that:

the left frame and the right frame are respectively arranged with a first buffer member, and the first buffer member is located between the inner peripheral face and the outer peripheral face of the left frame and the right frame and extended toward a lower side of the connection element, and comprises a plurality of compartments, each of the plurality of compartments having an opening which provides a flexible support to absorb the impact that acts on the wearer's nose bridge from several directions;

wherein the left frame and the right frame are respectively arranged with a second buffer member, and the second buffer member is located at a side of the connecting circumference of the protection pad and extended toward an upper side of the connection element, and the second buffer member comprises an arc support rib, and the arc support rib has a penetrating archway which provides a support and returning force against a structural deformation.

2. The swimming goggle structure of claim 1, wherein the plurality of compartments have the openings toward the outer peripheral face and are continuously extended and gradually enlarged from the inner peripheral face to the outer peripheral face in an interlaced arrangement to form a curved contact surface used to make contact with the wearer's nose bridge, and the openings of the plurality of compartments have geometry shapes to cooperatively form a honeycomb structure, an elliptical structure or a rectangular structure so as to provide the flexible support to the wearer's nose bridge.

3. The swimming goggle structure of claim 1, wherein the arc support rib of the second buffer member is protruded from the inner peripheral face of each of the left frame and the right frame and connected to the connecting circumference of the protection pad.

4. A swimming goggle structure, comprising:

a left frame and a right frame, respectively having an inner peripheral face, an outer peripheral face, a lens, a protection pad and a head strap base; and a connection element, interposed between the left frame and the right frame, characterized in that:

the left frame and the right frame are respectively arranged with a first buffer member, and the first buffer member is located between the inner peripheral face and the outer peripheral face of the left frame and the right frame and extended toward a lower side of the connection element, and comprises a plurality of compartments, each of the plurality of compartments having an opening which provides a flexible support to absorb the impact that acts on the wearer's nose bridge from several directions;

wherein the plurality of compartments of the first buffer member have the openings toward the outer peripheral face and are continuously extended and gradually enlarged from the inner peripheral face to the outer peripheral face in an interlaced arrangement to form a curved contact surface used to make contact with the wearer's nose bridge, and the openings of the plurality of compartments have geometric shapes to cooperatively form one of a honeycomb structure, an elliptical structure or a rectangular structure so as to provide the flexible support to the wearer's nose bridge.

5. A swimming goggle structure, comprising:

a left frame and a right frame, respectively having an inner peripheral face, an outer peripheral face, a lens, a protection pad and a head strap base; and a connection element, interposed between the left frame and the right frame, and integrally formed with the left frame, the right frame and the protection pads;

wherein each of the protection pads has a connecting circumference and a face contact circumference, and the connecting circumference is secured to the inner peripheral face of the left frame and the right frame, and the face contact circumference is used to make contact with the eye socket of the wearer, characterized in that:

the left frame and the right frame are respectively arranged with a first buffer member, and the first buffer member is located between the inner peripheral face and the outer peripheral face of the left frame and the right frame and extended toward a lower side of the connection element, and comprises a plurality of compartments, each of the plurality of compartments having an opening which provides a flexible support to absorb the impact that acts on the wearer's nose bridge from several directions;

wherein the left frame and the right frame are respectively arranged with a second buffer member, and the second buffer member is located at a side of the connecting circumference of the protection pad and extended toward an upper side of the connection element, and the second buffer member comprises an arc support rib, and the arc support rib has a penetrating archway which provides a support and returning force against a structural deformation; and wherein the left frame and the right frame are respectively arranged with a third buffer member, and the third buffer member is located at a side of the connecting circumference of the protection pad opposite the second buffer member, and the third buffer member comprises an arc support rib, and the arc support rib has a penetrating archway which provides a support and returning force against a structural deformation.

6. The swimming goggle structure of claim 5, wherein the arc support rib of the second buffer member is protruded from the inner peripheral face of each of the left frame and the right frame and connected to the connecting circumference of the protection pad.

7. The swimming goggle structure of claim 5, wherein the arc support rib of the third buffer member is protruded from the inner peripheral face of each of the left frame and the right frame and connected to the connecting circumference of the protection pad.

8. The swimming goggle structure of claim 5, wherein the left frame and the right frame are respectively arranged with a fourth buffer member, and the fourth buffer member comprises a plurality of compartments, and the plurality of compartments are extended in an interlaced arrangement from the third buffer member and located between the inner peripheral face of each of the left frame and the right frame and the connecting circumference of the protection pad so as to provide the protection pad with a buffer effect.

9. The swimming goggle structure of claim 8, wherein sizes of the compartments of the fourth buffer member increase gradually along with the extension of the fourth buffer member from a portion adapted to the wearer's nose bridge to a portion adapted to the wearer's outer eye corner, and an amount of the compartments of the fourth buffer member at a portion adapted to the wearer's eyebrow is less than an amount of the compartments of the fourth buffer member at a portion adapted to the wearer's zygomatic bone, so as to match the protection pads of which an axial length adapted to fit to the wearer's eyebrow is less than an axial length adapted to fit to the wearer's zygomatic bone, and thus to be adapted to fit to the contour of the wearer's eye socket having a raised top and a concave bottom to provide a compliant engagement.

* * * * *